US008365839B2

(12) United States Patent
Danesh

(10) Patent No.: US 8,365,839 B2
(45) **Date of Patent: *Feb. 5, 2013**

(54) SUBSTANTIALLY SIMULTANEOUS CORE CONTAINMENT, CORE RETRIEVAL AND BOREHOLE ABATEMENT

(76) Inventor: Bijan Danesh, St. Catharines (CA)

( * ) Notice: Subject to any disclaimer, the term of this patent is extended or adjusted under 35 U.S.C. 154(b) by 425 days.

This patent is subject to a terminal disclaimer.

(21) Appl. No.: 12/706,727

(22) Filed: Feb. 17, 2010

(65) Prior Publication Data

US 2011/0198124 A1 Aug. 18, 2011

(51) Int. Cl.
*E21B 25/06* (2006.01)
*E21B 25/10* (2006.01)

(52) U.S. Cl. ..... 175/20; 175/249; 175/252; 175/58

(58) Field of Classification Search ..... 175/20, 175/58, 249, 250, 252
See application file for complete search history.

(56) References Cited

U.S. PATENT DOCUMENTS

| | | | | |
|---|---|---|---|---|
| 2,108,949 | A * | 2/1938 | Snyder | 175/236 |
| 3,630,036 | A * | 12/1971 | Van Weele | 405/233 |
| 4,659,257 | A * | 4/1987 | Verstraeten | 405/248 |
| 2005/0133267 | A1 * | 6/2005 | Reid et al. | 175/58 |

* cited by examiner

*Primary Examiner* — David Andrews
(74) *Attorney, Agent, or Firm* — Jennifer Meredith, Esq.; Fariba Sirjani, Esq.; Meredith & Keyhani, PLLC

(57) ABSTRACT

Device, method and system for substantially simultaneous injection of air or sealant into a borehole resulting from extraction of a sampling assembly from a formation. An auxiliary conduit is attached along a sampling tube. Fluids, including a slurry or compressed air, are injected into the borehole as the sampling assembly is extracted. Injection of compressed air reduces or removes the suction of the vacuum forming below the retracting assembly. Introduction of a bentonite slurry seals the borehole that is opening as the sampling assembly withdraws. Fluids containing disinfectants or nutrients may be injected into the borehole as the assembly withdraws. Fluid flow of the auxiliary conduit may be used to activate a cut and cap mechanism for containing the sampled core. The auxiliary conduit is formed not to interfere with the insertion of sampling tube into the formation and is outfitted with mechanisms that keep the conduit closed during descent.

11 Claims, 12 Drawing Sheets

SUBSTANTIALLY SIMULTANEOUS CORE CONTAINMENT, CORE RETRIEVAL AND BOREHOLE ABATEMENT

BACKGROUND OF THE INVENTION

1. Field of the Invention

The present invention pertains generally to the field of environmental sampling and, more particularly, to collection of core from a formation.

2. Description of Related Art

Sampling tubes are driven through soils and sediments that compose a formation to collect a core for further study and analysis. As the sampling tube is driven into the formation, a sampled core from the material of the formation collects inside the sampling tube. After the sampling tube has passed through and collected core from a desired profile of the formation and has reached a desired depth of sampling, the sampling tube is extracted to retrieve the collected sample. As the sampling tube is extracted from the formation, a borehole is created in the place of the collected core.

During the sampling of soils and sediments using a sampling tube, the vacuum created due to the extraction of the sampling tube may cause sample loss from the tube. After the conclusion of sampling, the borehole that remains open creates a path for potential travel of contamination across the formation. Thus, the creation of the borehole impacts both the collected core and the formation that is left behind.

While the sampling tube is being extracted, a partial vacuum is created in the open space below the tip of the sampling tube. The partial vacuum places suction on the tube and the collected core inside the tube. Depending on the material of the formation that is collected near the tip of the sampling tube, and depending on how tightly this material is held to the tube, the suction may suck out the sampled core and result in loss of sampled material. A compact core is unlikely to be sucked out but a sample collected from fine and lose sandy material is probably lost to the suction of the vacuum.

Loss of sample due to the vacuum that is generated below a retrieving sampling apparatus is accepted in the field of sampling. The sampling tubes are driven below a desired depth to compensate for the uncontrollable and, at times, inevitable loss of sample.

After the conclusion of sampling, the open borehole presents a cross-contamination pathway. Once the sampling tube and the core that it includes are withdrawn, depending on the type of the formation, the borehole may remain open or might collapse. An open borehole is a pathway that provides an opportunity for cross-contamination between various layers of the formation. For example, in the sampled formation, several distinct aquifers may be separated by layers of less permeable material, such as clay. In multi-layer aquifer systems, a higher aquifer, that is closer to the ground surface, is contaminated by material seeping in through the ground surface; the deeper aquifers are nonetheless protected by the separating layers of low permeability clay. An open borehole creates a pathway from the contaminated aquifer to the lower and pristine aquifers which will lead to their contamination over time. As another example, if a layer of PCB contaminated soil lies beneath a lake, the soil and sediment below this contaminated layer may remain unaffected. An open borehole creates a conduit for the contamination to be carried to the unaffected layers. Subsequently, each layer transports the contamination horizontally according to its own transport parameters. Evan collapsed boreholes are pathways because the formation is not going to return to its original layered form in the area of the creation and collapse of the borehole.

Note that contamination need not travel downward in a borehole. Lower aquifers may be at higher pressures and the contaminated groundwater of a lower aquifer can travel up an open borehole to an overlying aquifer. In underwater sediments, the water that fills the borehole provides a medium of transfer in both directions.

One conventional method of abatement of open boreholes is sealing the hole by filling it with a low permeability material such as bentonite, which is a form of clay. Bentonite is injected into the borehole, in the form of a slurry, after the sampling assembly is withdrawn from the hole.

Slurry injection is used for other purposes in drilling applications. Slurry injection may be used as a lubricant to facilitate drilling in hard to drill formations. Such formations are usually drilled using a rotary drill bit and slurry is injected as the drilling proceeds. In other applications, after the core casing has been withdrawn from inside a drill bit, and while the drill bit is still in the ground, a slurry tube is conducted down the drill bit to inject slurry into the borehole. Rotary drills have a corkscrew drill bit that is hollow to make room for a core casing inside. As the rotary drill bit makes progress into the soil, sampled core is also collected inside the core casing. The core casing may be withdrawn while the borehole is kept open by the drill bit. The slurry is injected before the hollow drill bit is retrieved and the hole gets a chance to collapse. In such applications, however, withdrawal of the core casing creates an open pathway that remains open before the slurry injection.

SUMMARY OF THE INVENTION

Aspects of the present invention address the issues associated with retrieval of a sampling tube after collecting a sampled core from a formation.

Aspects of the present invention provide devices, methods and systems that address the issues of sample loss and open pathway that are associated with extraction of a sampling tube from a sampled formation. Aspects of the present invention further provide mechanisms for sample containment, otherwise referred to as cut and cap mechanisms.

Aspects of the present invention provide a device for collecting a sampled core from a formation. The device includes sampling tube sections adapted to being coupled together to form a sampling tube for containing the sampled core, a nozzle adapted for penetrating the formation and connected to a leading sampling tube section from among the sampling tube sections, and auxiliary conduit sections adapted to being coupled together to form an auxiliary conduit along the sampling tube. The auxiliary conduit is also adapted for delivery of a fluid to a borehole created by extraction of the device from the formation substantially simultaneously with the extraction of the device from the formation and creation of the borehole. The auxiliary conduit includes a stopper for substantially preventing entry of soils and sediments into the auxiliary conduit during descent of the device into the formation.

The nozzle may be a torpedo nozzle that includes a cylinder having a threaded end and a penetrating end opposite the threaded end, and fins protruding outward from an external surface of the cylinder, not interfering with a translational movement of the device through the formation, and resisting a rotational movement of the nozzle once inside the formation. The threaded end is adapted to be connected to the leading sampling tube section, and the cylinder is adapted for receiving an O-ring. The O-ring is adapted for deforming toward the sampled core, responsive to a compressive force resulting from a tightening of the threaded end to the leading sampling tube section.

The nozzle may be substantially conical to show little resistance to translational or rotational motion inside the formation. The auxiliary conduit sections may be fabricated integrally with the sampling tube sections. The auxiliary conduit sections may be attached to the sampling tube sections. The auxiliary conduit may include a protective casing, and an internal tube running through the protective casing. The auxiliary conduit may extend to the nozzle and the stopper is a check valve. The device may further include an inflatable core retainer ring adapted for being inflated by injection of the fluid from the auxiliary conduit and compressing the sampled core around a ring.

The device may further include a cut and cap conduit for triggering a cut and cap mechanism near a leading end of the sampled core. The cut and cap mechanism includes an inflatable core retainer ring adapted for being inflated by injection of fluid from the cut and cap conduit and compressing the sampled core around a ring.

Aspects of the present invention provide a method for collecting core from a formation. The method includes driving a sampling assembly into the formation, reaching a desired sampling depth, withdrawing the sampling assembly from the formation, activating an injection mechanism substantially simultaneously with the withdrawing of the sampling assembly to inject a fluid into a borehole being created by the withdrawing of the sampling assembly, and removing a collected core from the sampling assembly.

The fluid may be selected from compressed gas and slurry. Injecting of the compressed gas into the borehole reduces suction a vacuum generated in the borehole, and injecting of the slurry into the borehole seals the borehole as the borehole is being formed.

The method may further include activating a containment mechanism before the withdrawing of the sampling assembly. The activating of the containment mechanism includes injecting compressed gas into an inflatable core retainer ring located near a leading end of the sampling assembly. The sampling assembly may include a torpedo shaped nozzle for penetrating into the formation and a sampling tube screwed to the torpedo shaped nozzle for collecting the core, the torpedo shaped nozzle being receptive to translational insertion into the formation and resistive to rotation once inside the formation. Then, a deformable O-ring is placed in a space between the torpedo shaped nozzle and the sampling tube, the deformable O-ring adapted to deform toward a center of the sampling tube responsive to a compressive force, and activating of the containment mechanism includes rotating the sampling tube after the reaching of the desired sampling depth to tighten a space between the sampling tube and the torpedo shaped nozzle.

Aspects of the present invention include a system for collecting a core from a formation. The system includes means for collecting the core, means for extracting collected core, and means for injection of a fluid into a borehole created by the extraction of the collected core substantially simultaneously with the extraction of the collected core. The means for injection of the fluid into the borehole may further operate as a means for containing the collected core. The means for collecting the core may further operate as a means for containing the collected core. The means for collecting the core may include a sampling tube having a threaded end and a torpedo-shaped nozzle screwed to the threaded end of the sampling tube. The system may further include means for containing the collected core before the extracting of the collected core. The means for the injection of the fluid into the borehole may include means for preventing entry of soils and sediments during the collecting of the core.

DETAILED DESCRIPTION OF THE INVENTION

Figure 1:
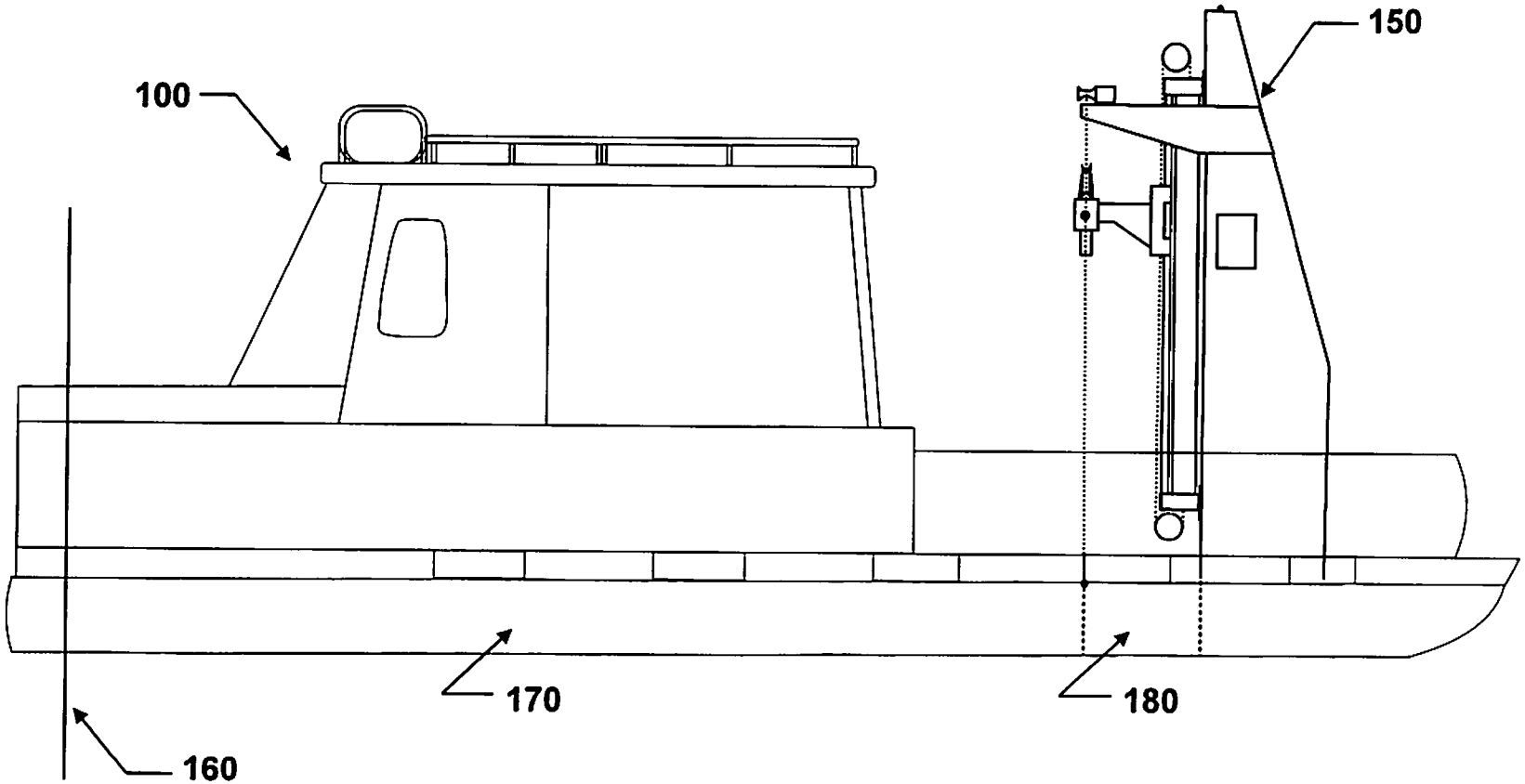
FIG. 1 shows a system for retrieving substantially undisturbed soil and sediment samples including a sampling vehicle, according to aspects of the present invention.

Aspects of the present invention allow the sampling tube to be extracted from a formation with reduced sample loss that typically occurs due to suction generated by the vacuum that is created below the withdrawing sampling tube.

Aspects of the present invention further seal the conduit generated by the borehole that remains after the extraction of the sampling tube substantially simultaneously with the extraction of the sampling tube.

Aspects of the present invention further provide containment of the sampled core inside the sampling tube during the withdrawal of the sampling assembly by effectively cutting the core and capping it inside the tube.

The devices, methods and systems of the aspects of the present invention address the issues associated with the extraction of a sampling assembly during the extraction and substantially simultaneously with the extraction. As such, aspects of the present invention are distinguished from conventional after the fact remedial measures that deal with the impact of sampling after the conclusion of sampling.

Some aspects of the present invention add an auxiliary conduit to the sampling tube. The auxiliary conduit is used to inject a fluid, such as compressed air or slurry, into the borehole as the sampling tube is being extracted.

As discussed above, slurry injection is not uncommon in prior art. Slurry is injected during some types of rotary drilling in order to lubricate the movement of the drill bit in the formation. Slurry injection to seal a borehole after sampling is also common. Such injection occurs after the core casing that holds the sample is withdrawn. At times, and depending on the type of sampling and drilling that is being conducted, a slurry tube is carried down by the drill bit as a part of the drill bit. However, in such situations, the core casing is withdrawn while the generally rotary drill remains in the borehole and slurry is not released until after the casing has been withdrawn.

The simultaneous nature of injection and extraction of the aspects of the present invention is distinguished from slurry injection that occurs during drilling, before extraction, or after the extraction of the sampling tube. The fact that the injected slurry does not interfere with or contaminate the collected core further distinguishes the aspects of the present invention from the slurry injection that occurs to assist and enhance drilling.

Further, some of the devices and systems that embody the aspects of the present invention are described in the context of a sampling device that is inserted into the formation by a translational force and through a translational movement that is generally in a straight downward direction. Thus, they are distinguished from the slurry tube carried down by a rotary drill. The devices and systems that embody the aspects of the present invention include a conduit that carries the injectable fluid as a part of the sampling tube or as attached to the sampling tube. As such, they are distinguished from slurry tubes that are inserted into a borehole after conclusion of drilling.

The term slurry is used to refer to generally fluid material, other than compressed air, that is injected into the borehole. The slurry that is injected may be a bentonite slurry used to seal the bore hole or a liquid or gel containing, disinfectants, oxidizing agents, bacteria or nutrients used for bioremediation of contaminated formations.

Aspects of the present invention may be utilized in conjunction with, or independently from, the devices, methods and systems disclosed in the co-pending U.S. patent application Ser. No. 12/695,675 ("the '675 application"), filed in the United States Patent and Trademark Office on Jan. 28, 2010, by inventor Bijan Danesh. The '675 application discloses devices, methods and systems for substantially undisturbed sampling of soils and sediments of a formation. Some aspects of the present invention provide devices, methods and systems that are described in the context of the invention described in the '675 application. The '675 application is used, however, as one exemplary platform to describe the aspects of the present invention and devices, methods and systems of the present invention are not limited to the context of the '675 application.

FIG. 1 shows a system for retrieving substantially undisturbed soil and sediment samples including a sampling barge, according to aspects of the present invention.

A system for retrieving substantially undisturbed soil or sediment samples includes a sampling vehicle 100, such as a boat or a barge that is equipped with a coring device 150. Before the start of sampling, the barge is anchored and stabilized by using spuds 160 that are driven into the sediments, by mooring anchors, or by filling a ballast portion 170 of the barge with water, or by a combination of these methods. The base of the barge has an opening 180 through which the coring device may reach the sediment below the barge. The coring device that is aboard the barge is used for collecting sediment samples according to an exemplary method shown in the flowchart of FIG. 2. Stabilizing the barge improves the quality of the sample collection. While a barge operates on a body of water, the coring device of the aspects of the present invention may be used for soil coring and sampling on land as well. For example, the device may be set up on a truck or may be placed directly on land.

Figure 2:
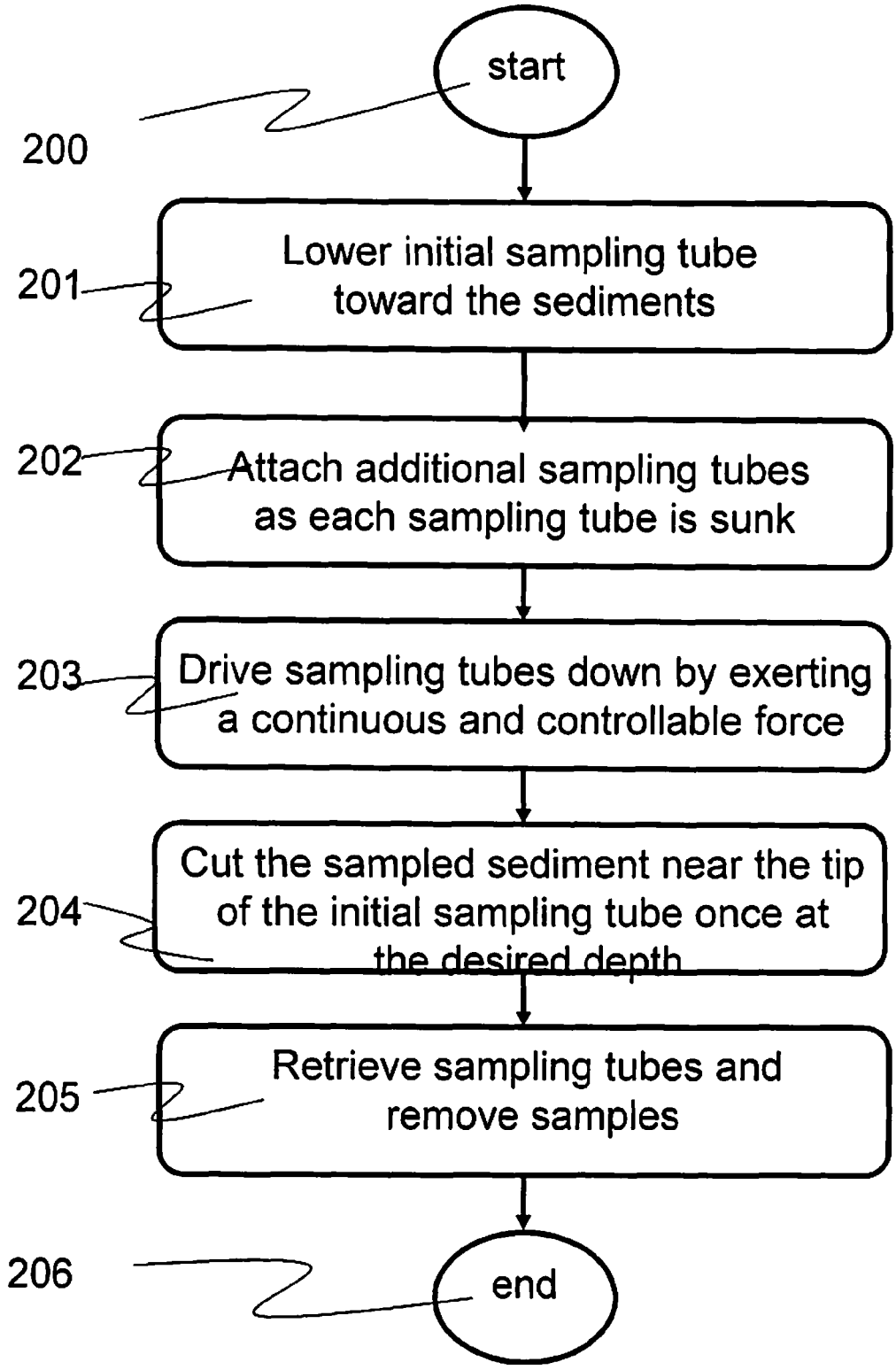
FIG. 2 shows a flowchart of a method of sampling soils and sediments, according to aspects of the present invention.

FIG. 2 shows a flowchart of a method of sampling soils or sediments, according to aspects of the present invention.

The method begins at 200. At 201, a core sampling tube is connected to the coring device and lowered into the water through the opening at the bottom of the barge. The lowering of the sampling tube is controlled such that it does not generate a wave that leads to resuspension of sediments below. The sampling tube is typically formed from sampling tube sections that are connected to one another. At 202, additional sampling tube sections are screwed, pinned or otherwise secured to a previous sampling tube section as each sampling tube section is lowered. Four-foot core tube sections may be used as the core sampling tube section. The sampling tube sections may be 2 to 6 inches in diameter. An appropriate diameter depends on the type of the formation and the objective of sampling. At 203, after the initial, and leading, sampling tube section has reached the surface of the bottom sediments below, the sampling device exerts a continuous and controllable translational force to drive the sampling tube through the sediments. Rotation or pounding of the coring tubes is not necessary. In some aspects of the present invention, the coring device is capable of exerting a variable force ranging between 0 to 60,000 lbf for driving the sampling tubes through the soil and sediments. In one aspect of the present invention, a force of 2500 lbf was tested. The translational force may be pneumatically generated. At 204, after the initial sampling tube section has reached the desired sampling depth, the sample is cut at or near the tip of the sampling tube. At 205, the sampling tube sections are retrieved and one by one dismantled and removed as they arrive on the vehicle or barge. At this point, the column of sample collected by each sampling tube section may be removed. At 206, the method ends.

Generally, a sampling tube includes two components of core casing and sampling-tube liner. The core casing is usually a steel tube with threading upon which a penetrating nozzle is mounted. The sampling-tube liner is a clear tube which fits inside the core casing and houses the undisturbed sample. The clear tube allows surface inspection and ensures sample preservation and protection of the sample structural integrity. The term "sampling tube" is used as a general term referring to a combination of both components. Various types of sampling tubes may be used, some of which, do not utilize a liner.

At 203, while the sampling tube sections are driven through the soil and sediments by an up and down translational force, the translational force may be complemented with a momentary vibratory motion for getting through obstructions that may be caused by debris or coarse material. The continuous and controllable translational motion may be generated by a pneumatic, electric or hydraulic driver.

Figure 3:
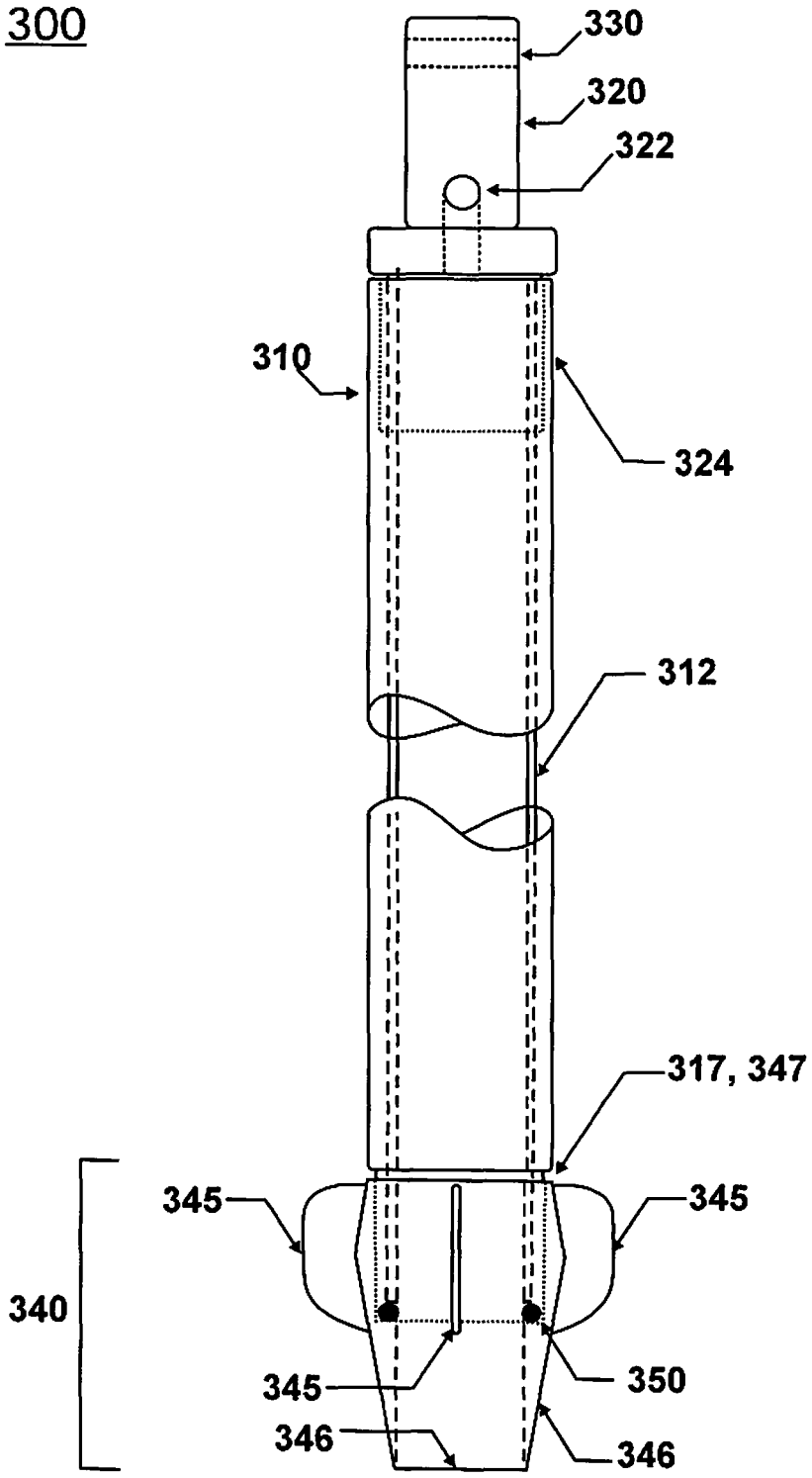
FIG. 3 shows a sampling assembly, according to aspects of the present invention.

FIG. 3 shows a sampling assembly, according to aspects of the present invention.

Sampling assembly 300 includes the parts that are connected together and penetrate the soil or sediments for sampling. The sampling assembly 300 includes a number of sampling tube sections 310 that are connected together and at the leading end connect to a nozzle 340. The successive sampling tube sections may be connected together by a variety of mechanisms including screwing of threaded areas, slotted locks, or being pinned together. The leading sampling tube section includes a threaded area 317 that screws into a corresponding threaded portion 347 of the nozzle or otherwise connects to the nozzle.

The sampling tube section 310 encompasses a liner 312 and is held by a core driver plug 320 or is connected to a next sampling tube section 310. A locking device 330 locks the core driver plug 320 to the rig or the sampling device. When the sampling tube section 310 is connected to the core driver plug 320, instead of being connected to another sampling tube section, a vent 322 permits for air and water to exit from the above.

The initial and leading sampling tube section 310 is connected to the nozzle 340.

In one aspect of the present invention, the nozzle 340 is shaped similar to a torpedo and is called the torpedo 340. The torpedo 340 is threaded inside the upper portion to receive the sampling tube section 310. The torpedo 340 ends in a penetrating nozzle 346 at the leading portion. The penetrating nozzle 346 has a sharp and cutting edge that cuts through the soils and sediments as the sampling tubes are pressed down. The diameter of the penetrating nozzle 346 and the liner 312 are substantially equal.

The torpedo 340 includes fins 345 around the circumference of its upper portion. One or more fins may be located around the torpedo. The fins 345 are substantially parallel to the longitudinal axis of the torpedo and the sampling tube to which it is screwed. As such, the fins do not interfere with the descent of the torpedo into the soils or sediments and may indeed accommodate the descent in some types of formations.

Some aspects of the present invention place an O-ring 450 inside the torpedo 340 between where the threading 347 ends and the penetrating nozzle 346 begins. O-rings are manufactured in various cross-sections including circular or rectangular cross-sections. Either, type is applicable. Initially, when the torpedo 340 is connected to the sampling tube 310, the sampling tube is screwed inside the torpedo such that the O-ring remains substantially flush with the liner 312 and the interior wall of the penetrating nozzle 346. As such, the O-ring does not interfere with the core that is collected inside the sampling tube as the sampling tubes penetrate through the soils or sediments.

An O-ring, also known as a packing, or a toric joint, is a mechanical gasket in the shape of a torus. It is usually a loop of elastomer with a disc-shaped cross-section, designed to be seated in a groove and compressed during assembly between two or more parts, creating a seal at the interface. Aspects of the present invention utilize O-rings made from material of different hardness, including rubber, neoprene, PVC, Teflon, plastic, metal or other material, depending on the hardness of the core that is to be pinched by the bulging action of the O-ring.

Once the desired sampling depth is reached and the sampling tubes are to be retrieved, the sampling tubes are rotated by the coring device to tighten the connection between the sampling tube and the torpedo. The fins 345 of the torpedo 340 hold the torpedo in place and permit such tightening to take place. Without the fins, the torpedo would rotate with all the other sampling tubes to which it is directly connected or indirectly coupled.

As a result of such tightening, the O-ring that was installed to be flush with the internal surface of the liner 312 and the penetrating nozzle 346 tends to bulge inward. The bulging O-ring reduces the internal diameter of the sampling apparatus and pinches the perimeter of the sample at the location of the O-ring. The pinch causes a discontinuity in the soils or sediments inside the sampling assembly 300 and the discontinuity causes the core to break at the location of the discontinuity when the sampling assembly is retrieved. A slight tightening and a slight bulge may be sufficient for achieving the objectives of the sampling. The tightening of the perimeter at the bulging O-ring further keeps the upper part of the core in place by squeezing the core below. The mechanism provided by the torpedo prevents loss of sample which occurs by slide back of sample due to weight of the sample and the vacuum below the core that is created during ascent.

As discussed above, during the retrieval of the sampling tubes, the vacuum created below the sampling assembly may pull down some of the sampled core and result in the loss of the sample as well as loss of information regarding the stratification. Aspects of the present invention prevent or reduce the possibility of sample loss by creating an intentional discontinuity and structural weakness in the core, below which, the core is free to break off and fall out.

Unlike the catcher of the prior art, the pinch does not disturb the core all the way along the sample. Unlike driving the sampling tubes into hard material to create a cap for the core, the pinch does not compress the sampled core.

When sampling in the relatively soft sediments under rivers, lakes, reservoirs, marshes, and ponds, an O-ring made from a rubber material would be sufficient to create an indentation or a cut around the sample core. However, the devices manufactured according to aspects of the present invention may be utilized for sampling in harder formations if the O-ring that is used is made from a suitably harder material such that the compression of the O-ring is capable of creating a cut in the harder formations. As long as the material of the O-ring is not as resistant as the sampling tube and the torpedo that squeeze the O-ring from two sides, it is the O-ring that will yield and move inward toward the sampled core. Harder O-rings may not be reusable because they may undergo plastic deformation and fail under the pressure. Such O-rings may be replaced for each round of sampling.

While the preceding drawing and description pertain mostly to a torpedo shaped nozzle, alternatively, the nozzle may be conical or partially conical in shape to assist displacement of soil and penetration into the soil. Variations of a conical shape, such as a pyramid with a triangular, rectangular, pentagonal, hexagonal, or higher order shape that approaches a circle or ellipse, may also be used. A torpedo shaped nozzle, described above, has the features of a generally conical nozzle with added fins. Both a cone and a torpedo may be inserted into the formation by a translational force and motion. However, a torpedo shaped nozzle is resistant to rotational motion once it is inserted into the formation, while a generally conical nozzle does not resist rotation. Therefore, other mechanisms are used for cutting and capping a sample that is collected by a sampling assembly that includes a conical nozzle.

Figure 4:
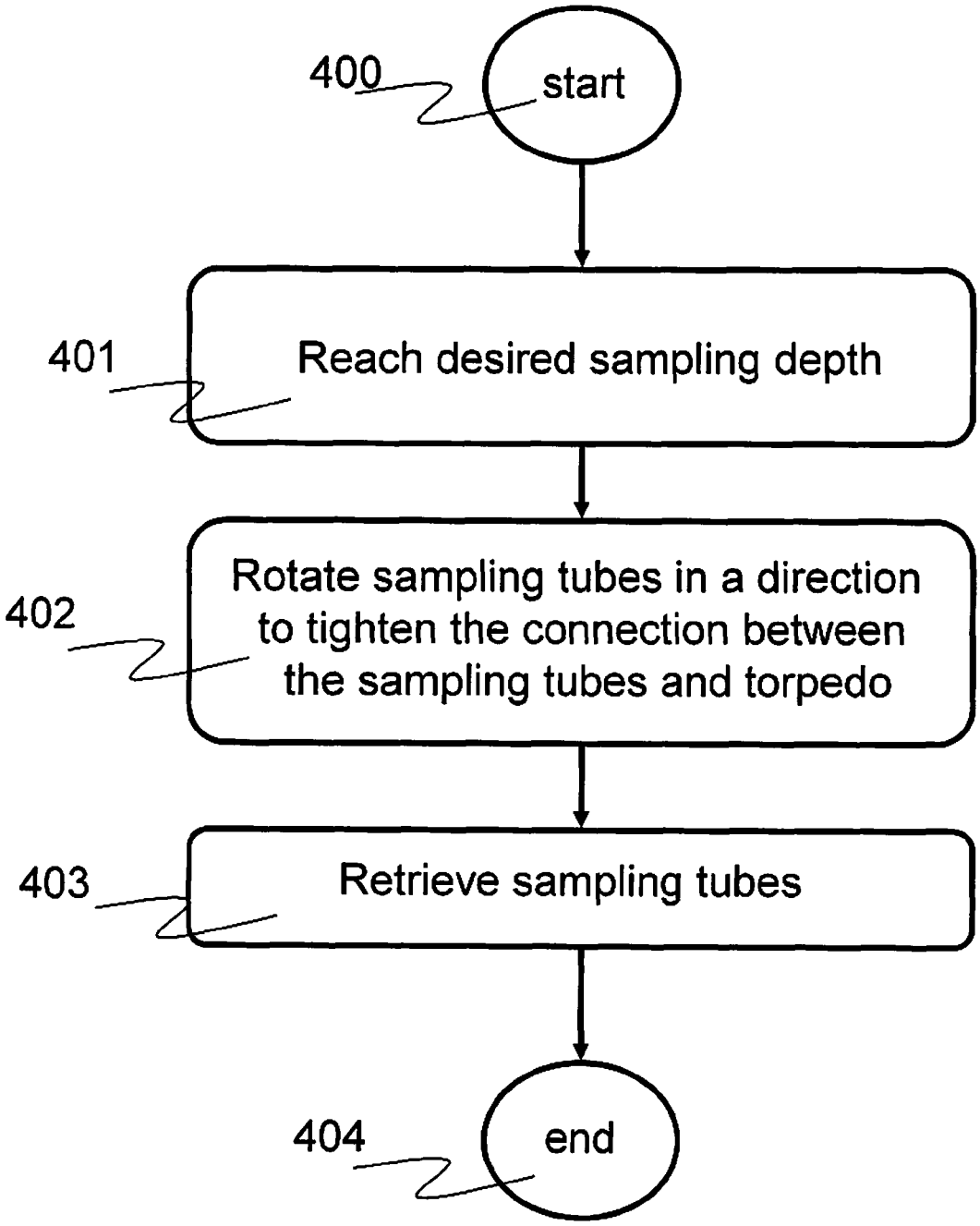
FIG. 4 shows a flowchart of a method of retrieving sampled soils and sediments, according to aspects of the present invention.

FIG. 4 shows a flowchart of a method of retrieving sampled soils or sediments, according to aspects of the present invention.

This method begins at 400. At 401, the sampling assembly has reached the desired maximum sampling depth. At 402, the sampling tubes are rotated in a direction to tighten their connection with the torpedo. As explained above, the fins hold the torpedo in place and make the tightening action possible. Without the fins, the entire assembly would rotate together and no tightening would take place. The tightening action creates a bulge in the O-ring that cuts the core ever so slightly and creates a structural weakness in the core at the location of the cut. At 403, the sampling apparatus is retrieved. Whether slight or severe, the cut created by the bulging O-ring around the perimeter of the sampled core causes the core to separate from the formation below at or near the location of the cut. As such, the likelihood that the sampled core above the O-ring is retrieved without loss increases significantly. At 404, the method ends.

Figure 5:
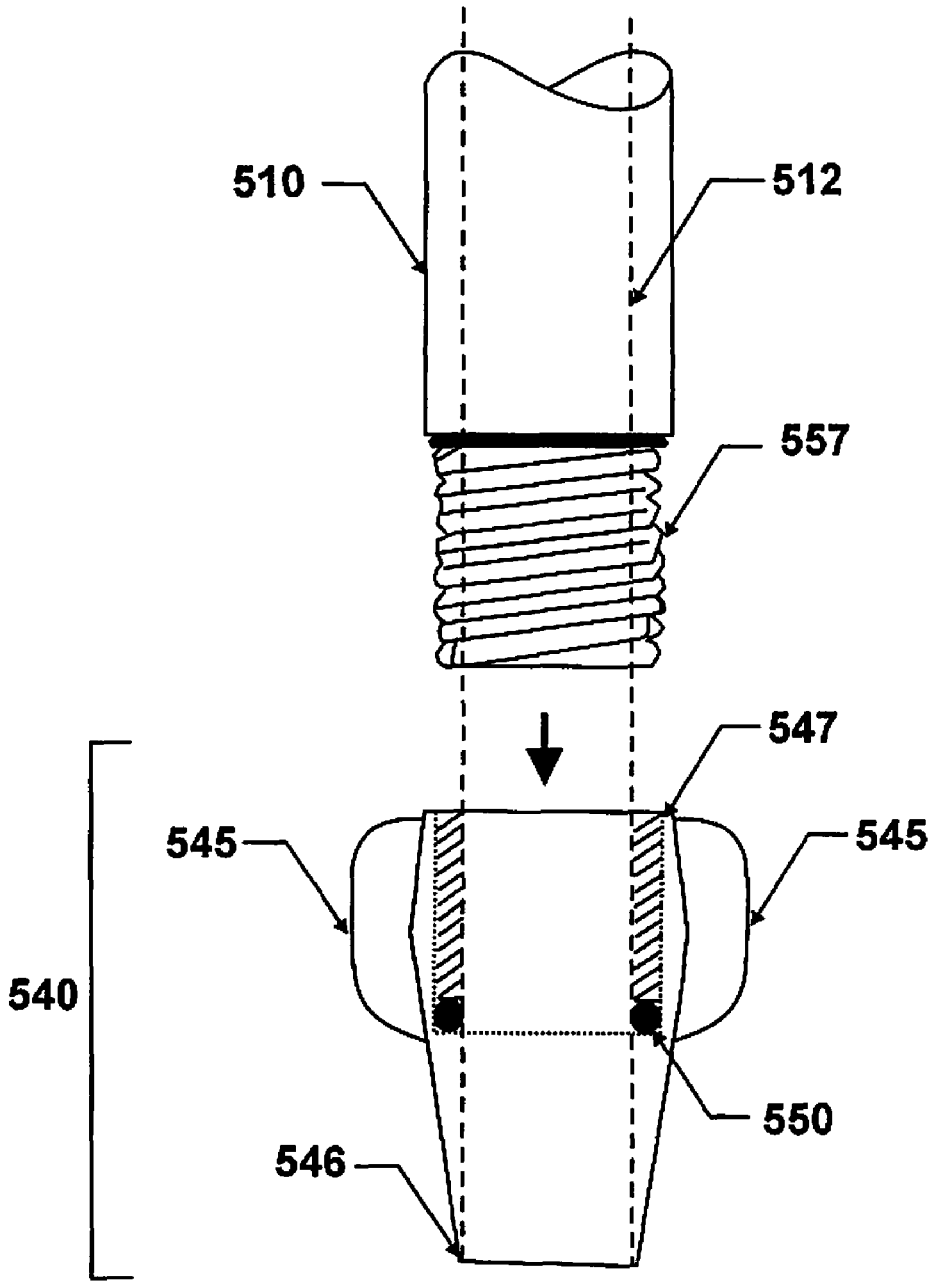
FIG. 5 shows a sampling tube connected to a torpedo, according to aspects of the present invention.

FIG. 5 shows a sampling tube connected to a torpedo, according to aspects of the present invention.

Sampling tube 510 is connected to torpedo 550 at threaded area 557. A liner 512 is located inside the sampling tube 510. The torpedo 550 also includes a threaded portion 547 that screws together with the threaded area 557 of the sampling tube. The torpedo 540 ends in a penetrating nozzle 546. An O-ring 550 is placed at the bottom of the threaded portion 547 of the torpedo, where the threaded area 557 of the sampling tube 510 and the torpedo 540 are screwed together.

When compared to the torpedo 340 of FIG. 3, the torpedo 540 shown in FIG. 5 has fins 545 that extend further down toward the penetrating nozzle 546 portion of the torpedo. Further, the location of threading 547 that is followed by the location of the O-ring 550 may be adjusted up and down the torpedo. In various aspects of the present invention, the treading and the O-ring may be located further away from the penetrating nozzle 546 and, for example, above the fins.

Figure 6:
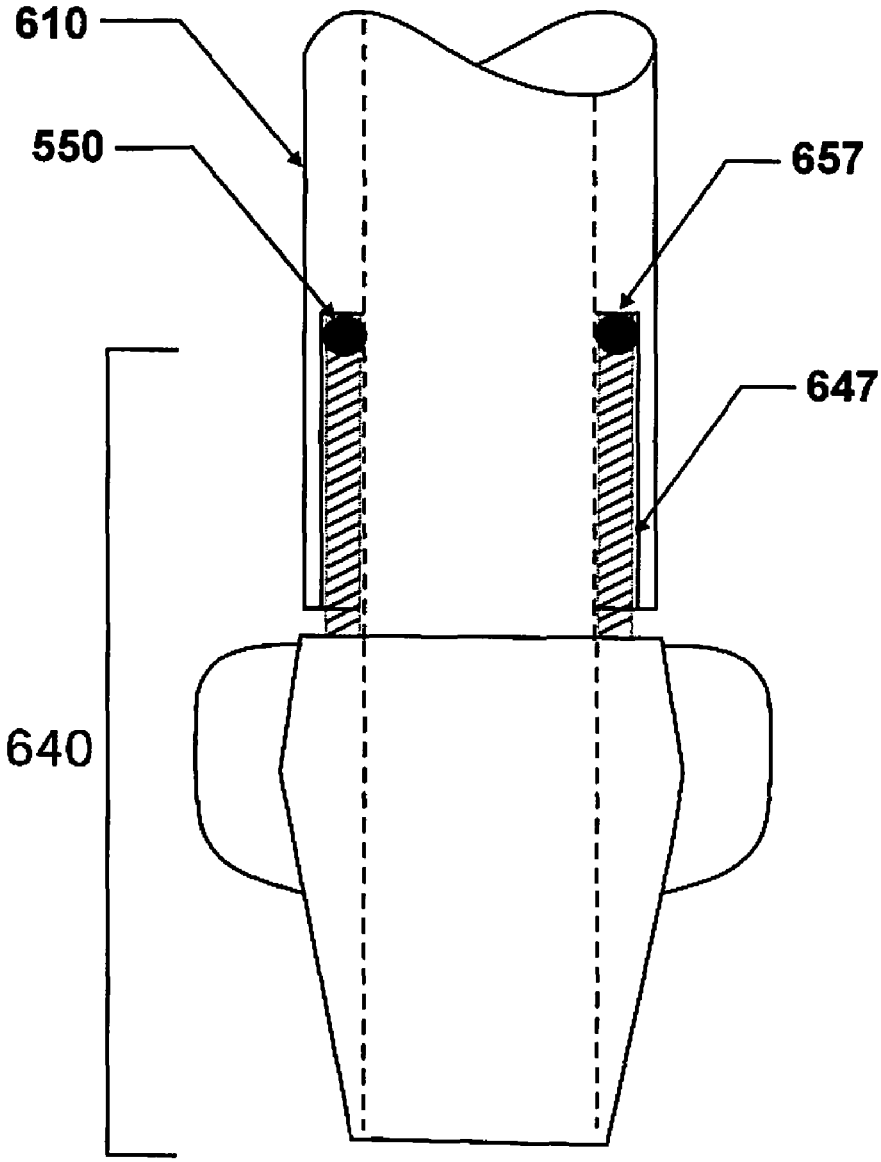
FIG. 6 shows a further exemplary connection between a sampling tube and a torpedo, according to aspects of the present invention.

FIG. 6 shows a further exemplary connection between a sampling tube and a torpedo, according to aspects of the present invention.

Various arrangements of the connection between the torpedo and the connecting sampling tube may achieve the same cutting functions. For example, in FIG. 6, threaded portion 647 of torpedo 640 extends outward above the fins and threading 657 of sampling tube 610 encompasses the threaded portion 647 of the torpedo. Nonetheless, when the sampling assembly penetrates into the soils or sediments and torpedo is held in place by the fins, tightening of the sampling tube 610 around the torpedo 640 causes a bulging of the O-ring 550 and a cutting of the core inside.

The torpedo may be built from various materials such as stainless steel. The fins may be stainless steel and may be welded onto the body of the torpedo or may be integrally formed when the torpedo is built in a foundry.

Figure 7:
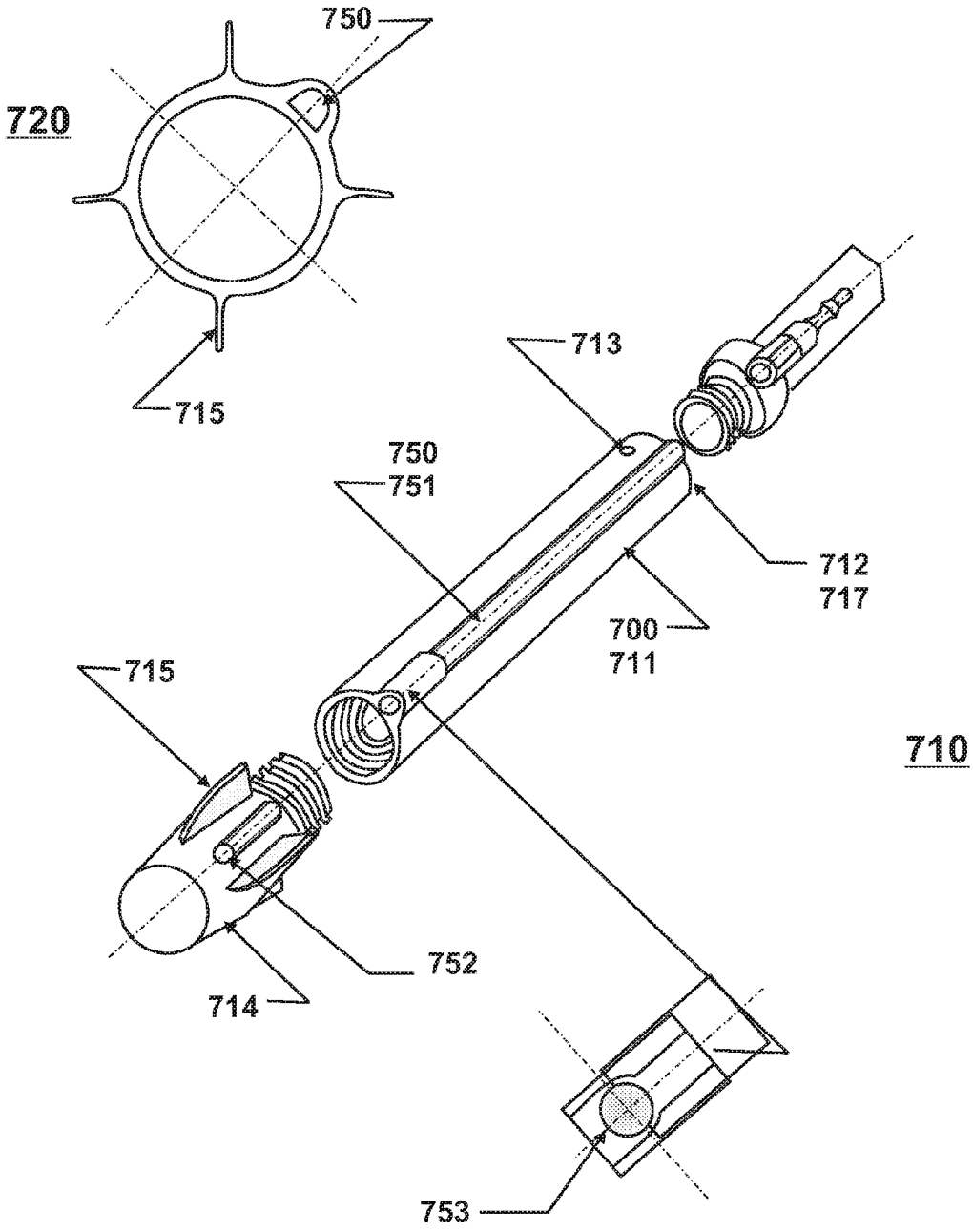
FIG. 7 shows a sampling tube including an auxiliary conduit, according to aspects of the present invention.

FIG. 7 shows a sampling tube including an auxiliary conduit, according to aspects of the present invention.

A perspective view 710 and a cross sectional view 720 of a sampling tube 700 are shown in FIG. 7. Both views 710, 720 of the sampling tube 700 show an auxiliary conduit 750 running along the length of the sampling tube 710.

The sampling tube 700 includes sampling tube sections 711 that are screwed together at threaded areas 712. The sampling tube sections may be held together by a different mechanism that does not require rotation, such as a set screw, a pin or a different type of coupling that does not interfere with the descent of the tube into the formation.

The sampling tube 700 additionally includes the auxiliary conduit 750 along all or most of its length. The auxiliary conduit is also broken into auxiliary tube sections 751 that correspond to the sampling tube sections 711. The auxiliary conduit sections 751 may be integrally formed with the sampling tube sections 711 in a foundry or may be welded onto the sampling tube sections at a later point. For example, an auxiliary conduit having an aperture of approximately ¼ of an inch in diameter may be welded along an outer surface of a core casing of 2 inches of diameter. Other sizes may be used.

The leading sampling tube section 711 is connected to a nozzle 714 that is the leading part of the sampling assembly that penetrates the soil or sediments. A tip 752 of the auxiliary conduit 750 is designed to be substantially flush with the leading nozzle 714. Further, the tip 752 includes a cap or stopper 753 that may be formed by a check valve or a pin. The cap or stopper 753 prevents entry of sediments into the auxiliary conduit during the driving of the sampling assembly into the formation.

External O-rings or washers 717 may be used to seal the sections 711 of the sampling tube together. The washers 717 are used between the nozzle 714 and the leading sampling tube section as well as in between all other sections 711 of the sampling tube. The external washers 717 protect the sampled cored from being affected by the fluid that flows in the auxiliary conduit.

In FIG. 7, the nozzle 714 is shaped as a torpedo including fins 715. The torpedo-shaped aspect of the nozzle is used, among other things, for cutting and containing the core inside the tube. A torpedo shaped nozzle takes advantage of the contrast between the translational force that moves the sampling tube into the formation and a rotational force that is resisted by the fins of the torpedo. The resistance of the fins of the torpedo to the rotation of the torpedo head, while the remainder of the sampling tube is impacted by a rotational torque, presses an internally placed O-ring causing it to bulge inward and cut the sample at the interface between the torpedo head and the sampling tube.

The nozzle, however, need not be limited to a torpedo shaped nozzle. When other mechanisms for cutting and containing the sample near the tip of the sampling tube are used, other shapes may be used for the nozzle. For example, a cone shaped nozzle may be used that does not include fins and is not resistant to a rotation force. The cone shaped nozzle is adapted for penetration into the soils and sediments under a translational force as is the torpedo shaped nozzle 714. The cone shaped nozzle, however, does not resist rotation and can be driven into the formation using a rotary motion as well.

Figure 8:
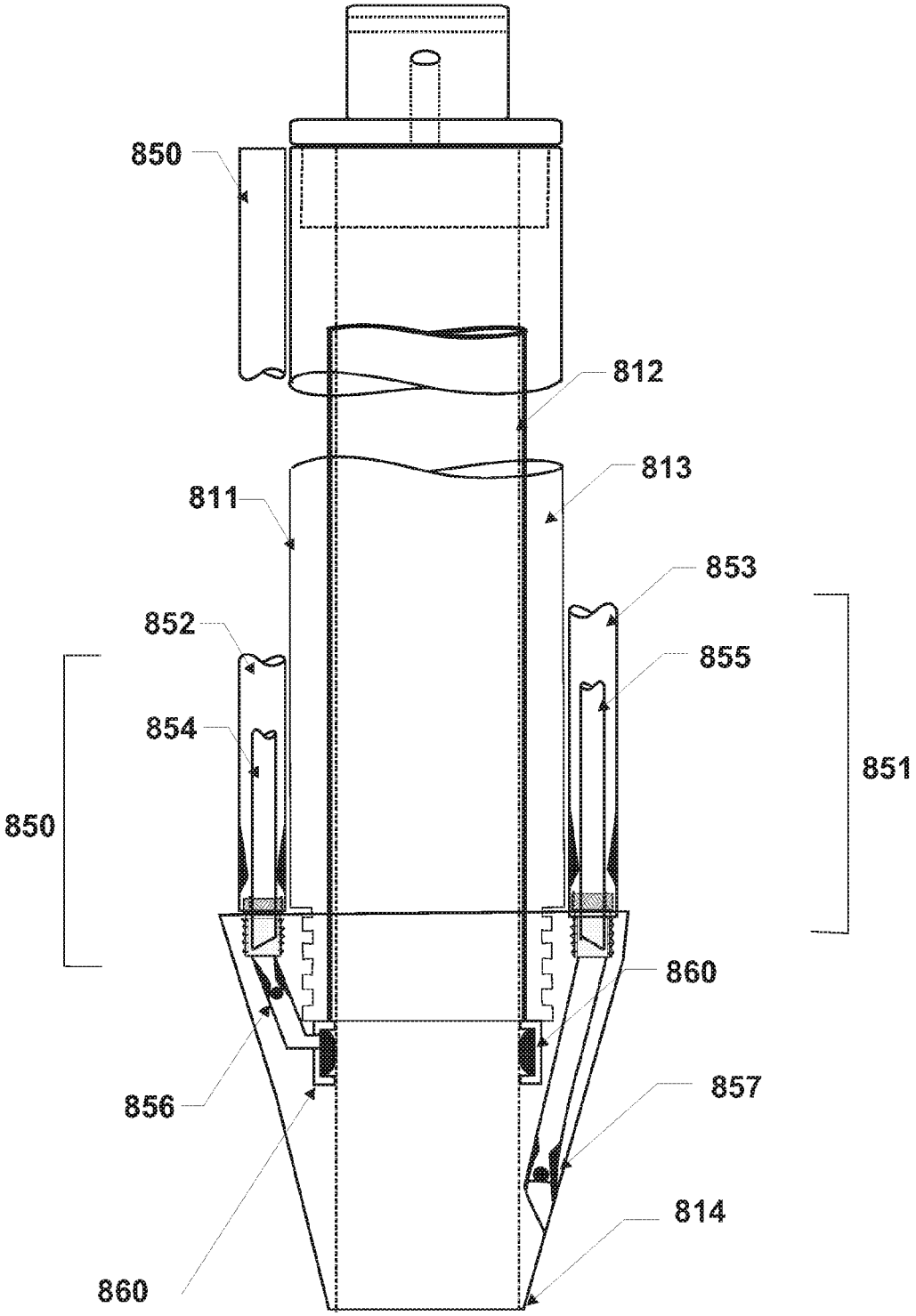
FIG. 8 shows various mechanisms for containing a sampled core within a sampling tube, according to aspects of the present invention.

FIG. 8 shows various mechanisms for containing a sampled core within the sampling tube, according to aspects of the present invention.

The use of an internal O-ring that is compressed by a tightening of the space between the leading sampling tube and a torpedo nozzle is described above in detail. Other mechanisms for containing the collected core are also possible.

Auxiliary conduit 850 is capable of delivering a pressurized fluid that may be used as a trigger for other cutting and capping mechanisms. Thus, the addition of the auxiliary conduit 850 to the sampling tube makes it possible to utilize cutting and capping mechanisms and methods that do not require the torpedo nozzle.

For example, the cutting of the core may be performed by inflating an inflatable core retainer ring 860 that may be placed between any two of the connecting sampling tube sections 811 or between the leading sampling tube section 811 and nozzle 814. The inflatable core retainer ring 860 may be implemented by a doughnut shaped washer. During the descent of the sampling assembly, the doughnut shaped washer 860 is maintained in a deflated state not to interfere with the collection of the core. After reaching the desired sampling depth and when containing of the sampled core is desired, the washer may be inflated or induced to otherwise change its shape. The auxiliary conduit 850 may be used to inject compressed air into the washer to inflate the washer and place pressure on the core inside the tube. This mechanism does not rely on the tightening of the connection where the washer is located. Rather, it relies on the expansion of the washer in the existing space. The expansion of the washer may be used instead of the compression of the O-ring, that is used with torpedo head nozzles, or in addition to it.

In the exemplary implementation shown in FIG. 8, sampling tube section 811 is shown as including a sampling tube liner 812 and a core casing 813.

The terms "cutting" and "capping" or "containing" were qualified in the description of the operation of the torpedo. Often, a ring of pressure around the core is sufficient to create a structural discontinuity that causes the core to fracture at or near the discontinuity. Further, the compression of the core may effectively operate as a capping when the part of the core below the compressed zone falls off and the remainder of the core is held in place by the more compact sediment of the compressed zone. With the use of a trigger mechanism as strong as the hydraulic mechanism provided by the auxiliary conduit, a switchblade may be used that cuts through the core and caps it.

FIG. 8 shows additional details that may be implemented in one exemplary aspect of the invention. For example, the auxiliary conduit 850 may be implemented using a protective casing 852 and an internal tube 854 that actually contains and carries compressed air or other fluid. The auxiliary conduit 850 connects to the inflatable core retainer ring 860 through a check valve 856. In the exemplary implementation shown in FIG. 8, the inflatable core retainer ring is placed within nozzle 814. This ring, however, may be placed further up the sampling assembly.

In the exemplary implementation of FIG. 8, two separate auxiliary conduits, a cut and cap auxiliary conduit 850 and an injection auxiliary conduit 851 are used. The cut and cap auxiliary conduit 850 ends in the inflatable core retainer ring 860 and is used to trigger the cut and cap mechanism. The injection auxiliary conduit 851 ends near a tip of the nozzle 814 and is protected from entry of soils and sediments by check valve 857. The injection auxiliary conduit 851 is used for injection of slurry or compressed gas into the borehole near the tip of the nozzle 814. The injection auxiliary conduit is also implemented using a protective casing 853 and an internal tube 855 that is protected by the protective casing 853 and is used for feeding the fluid to the borehole.

While FIG. 8 shows two separate conduits for triggering a containment mechanism and for injection into the borehole, the same auxiliary conduit may be used for both purposed. For example, compressed gas may pressure the ring 860 before continuing down to the borehole. Alternatively, by modification of the conduit in the nozzle area, an injected slurry would enter the ring on its way to the borehole. If the containment mechanism is activated shortly before the extraction of the sampling assembly, and before the borehole begins to open, then the pressure from the injected fluid has no place to go but into the cut and cap mechanism.

Figure 9:
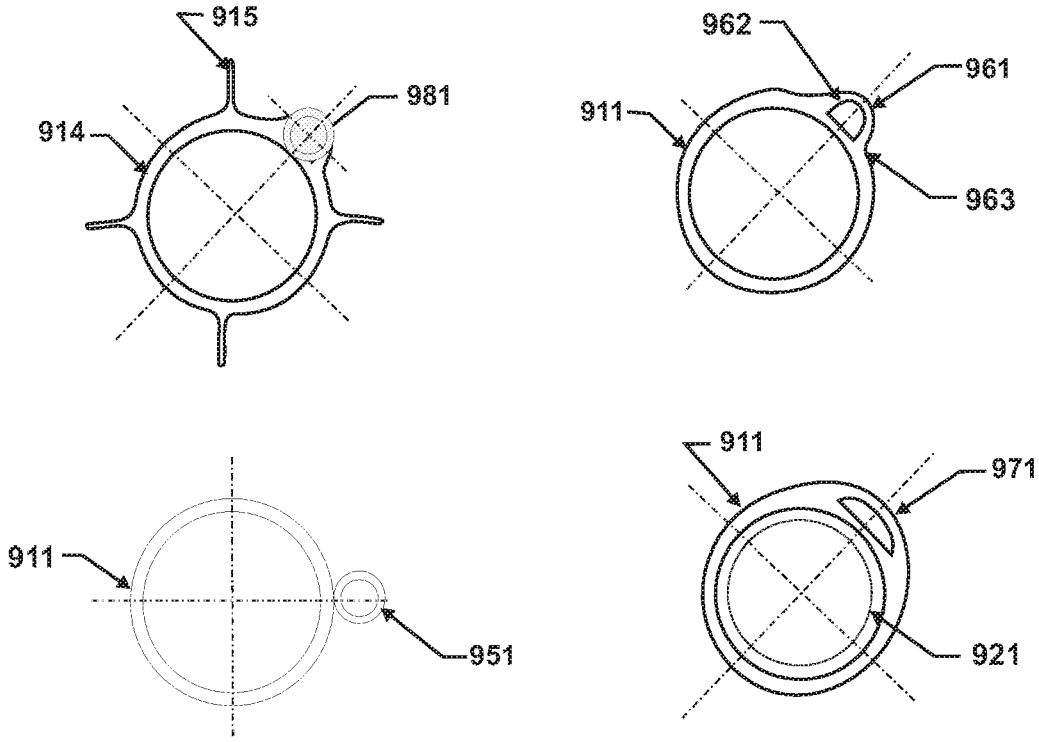
FIG. 9 shows various cross-sectional areas of an auxiliary conduit, according to aspects of the present invention.

FIG. 9 shows various cross-sectional areas of an auxiliary conduit, according to aspects of the present invention.

In FIG. 7, the Auxiliary conduit 750 is shown as including sections of a tube with a circular cross-section that are attached to, welded upon, or manufactured integrally with the sampling tube sections 711. A sampling tube section 911 and an associated auxiliary conduit section 951 with a circular cross-section are shown in FIG. 9. However, the auxiliary conduit, and thus the auxiliary conduit sections, need not be a tube or have a circular cross-section.

A conduit section 961 formed over or attached onto the sampling tube section may have a substantially semicircular internal cross-section with its diameter adjacent to the surface of the sampling tube section 911 or any other appropriate shape. Inner contour 962 of the auxiliary conduit is such that it is conducive to the flow of the slurry or compressed gas conducted by the conduit.

Outer contour 963 of the auxiliary conduit may be formed such that it does not interfere with the translational motion of the sampling tube. For example, the outer contour 963 may merge with the outer surface of the sampling tube as shown in the cross-sectional view.

Further the conduit 971 may be formed inside the core casing that forms the sampling tube in addition to or in lieu of the being formed outside the core casing over the sampling tube sections. If the sampling tube includes a liner 921, the auxiliary conduit and the liner may coexist inside the core casing. Then, the inner contour of the conduit is designed not to interfere with the entry of core into the sampling tube. For example, a crescent shaped auxiliary conduit 971 may be formed inside the sampling tube that does not interfere with the core collection function of the sampling tube.

An auxiliary conduit that is placed inside a sampling tube, or is constructed to be substantially flush with the outer contour of the sampling tube would be amenable to rotational motion and may be driven by a translational or rotary action.

The auxiliary conduit may have a diameter much smaller than the diameter of the sampling tube. However, any size tube that is desirable and does not interfere with the operation of the sampling tube may be used. For example, if the auxiliary conduit is placed outside the sampling tube and the sampling tube is connected to a torpedo-shaped nozzle, then the size of the auxiliary conduit must not be such that it reduces the effectiveness of the fins of the torpedo for preventing a rotation motion of the tube. As shown in FIG. 9, a very large auxiliary conduit 981 with a smooth outer surface contour that merges with the tube or nozzle 914 outer surface has the capability of neutralizing the impact of the fins 915 if the fins are few and small.

Figure 10:
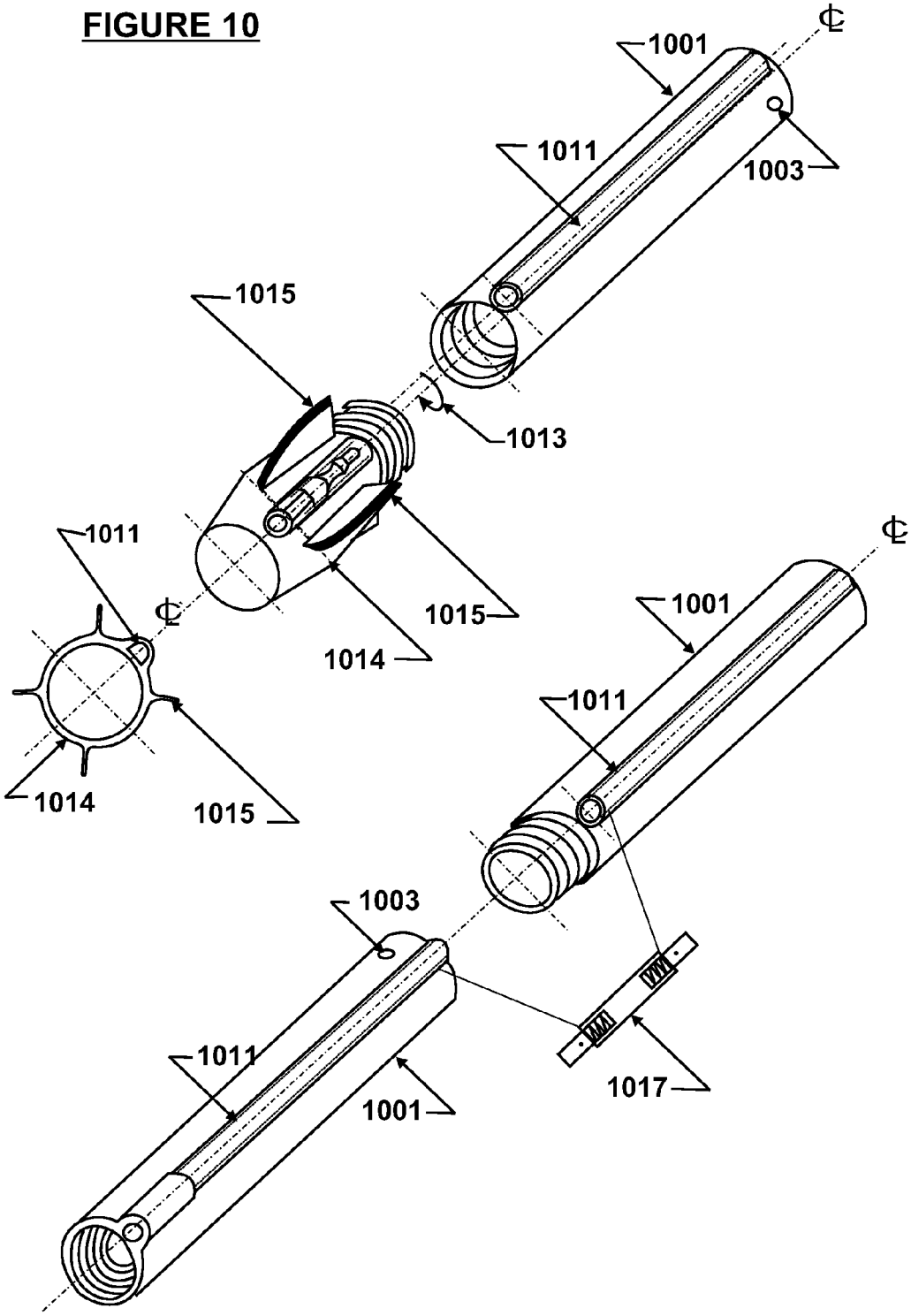
FIG. 10 shows various mechanisms of sealing together sections of the auxiliary conduit along a length of a sampling tube, according to aspects of the present invention.

FIG. 10 shows various mechanisms of sealing sections of the auxiliary conduit together along a length of the sampling tube, according to aspects of the present invention.

In one exemplary aspect of the present invention, during the connecting of the sections 1001 of the sampling tube together, auxiliary conduit sections 1010 are aligned. Then, in order to prevent misalignment during the lowering of the tube or during rotation of the tube, set screws 1003 may be used at each connection between two adjacent sampling tube sections 1001. The set screws 1003 prevent the sections from turning with respect to each other and from tightening or loosening of the connection after the sections have been screwed to a certain desirable degree. The use of the set screws preserves the alignment of the sampling tube sections 1001 that is appropriate for alignment of the auxiliary conduits 1011.

At the connection between the leading sampling tube and a torpedo shaped nozzle, set screws are not used as they would interfere with the rotation of the sampling tube section with respect to the nozzle head and such rotation is desirable a this junction. When a torpedo shaped nozzle is used with the sampling assembly, the internal cross-sectional area of the auxiliary conduit section that is on the nozzle and the internal cross-sectional area of the auxiliary conduit section that is on the leading sampling tube section must be such that they line up after the twisting of the sampling tube that is performed to cut the core. Side wings 1013 may be used to keep the auxiliary conduit sections 1011 closed until such time that the flow of fluid is desirable. Side wings 1013 on one or both of the nozzle 1014 and the sampling tube section can block the conduit 1011 between the two sections 1001, or between the sampling tube section 1001 and the nozzle 1014 until the tube is twisted. The rotation of the sampling tube aligns the openings of the auxiliary conduit sections in addition to the cutting of the core that is achieved by the use of fins 1015.

Other mechanisms may be used for sealing sections of the auxiliary conduit together that preserves the alignment of the openings within the conduit sections. For example, spring loaded attachments 1017 may be used between two conduit sections 1011 that lock the conduit sections together at the junction between two sampling tube sections 1001. Such attachments require a lower degree of attention and accuracy from the field personnel because the attachment itself provides alignment. The presence of the attachment further prevents additional rotation of the sampling tube sections with respect to one another at the junctions.

External washers or other sealing mechanisms are used between two connecting sections of the sampling tube to prevent any slurry that may escape from the auxiliary conduit from entering the sampling tube at the seams created by the junctions.

Figure 11:
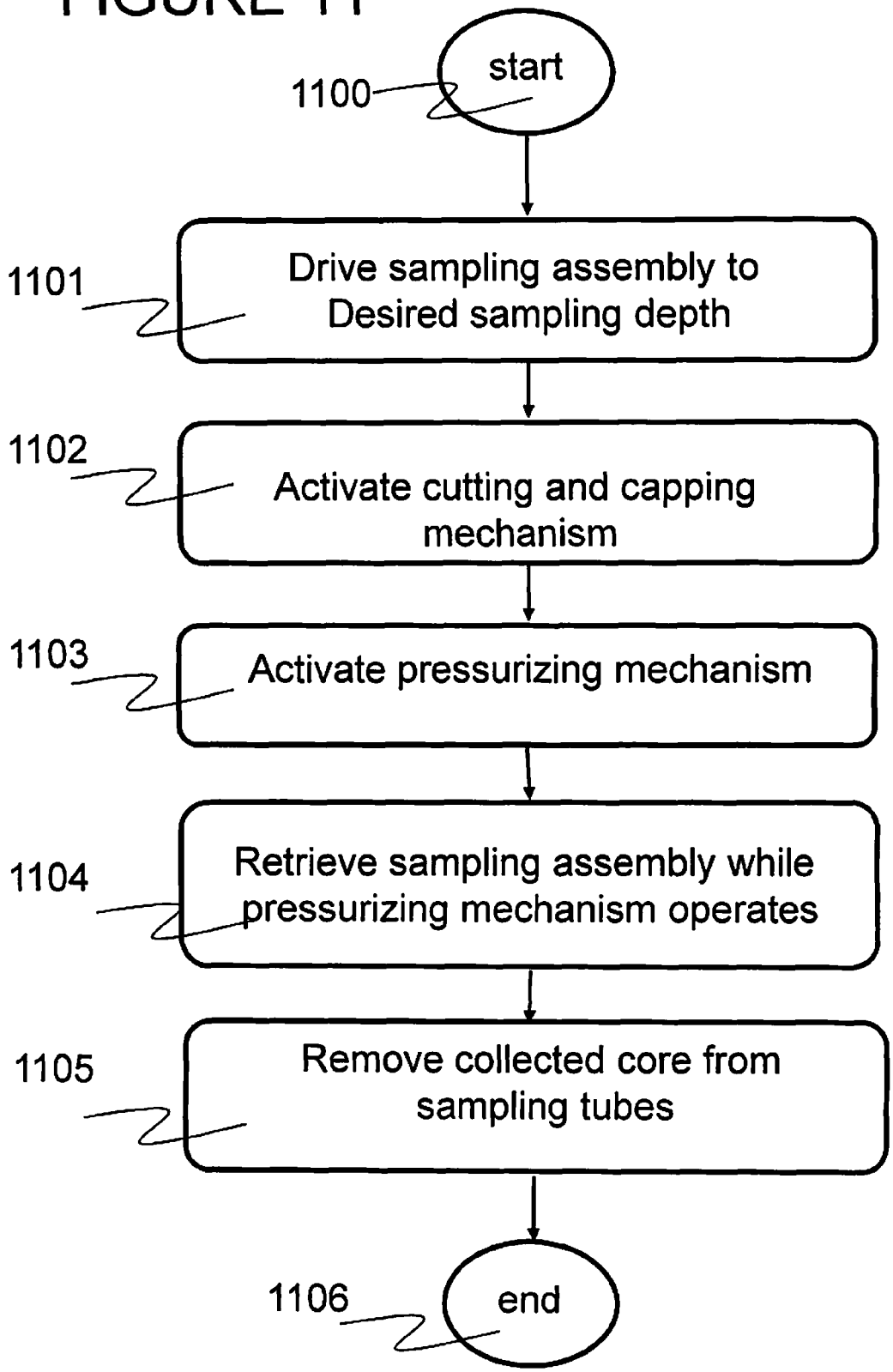
FIG. 11 shows a flowchart of a method of reducing a vacuum generated due to retrieval of a sampling assembly from a borehole, according to aspects of the present invention.

FIG. 11 shows a flowchart of a method of reducing a vacuum generated due to retrieval of a sampling assembly from a borehole, according to aspects of the present invention.

At 1100, the method begins.

At 1101, the sampling assembly is driven to the desirable sampling depth in the formation. The driving mechanism may be translational, rotary, vibrational or any combination. The sampling assembly includes a sampling tube ending in a leading nozzle and an auxiliary conduit that extends along the sampling tube and partially or completely along the nozzle. For most applications, the sampling tube in turn includes sampling tube sections that are connected together. The sections are typically made from 4-foot long steel tubes. However, non-cylindrical sampling tube sections having a non-circular cross section may also be used. The auxiliary tube includes auxiliary tube sections that are formed integrally with the sampling tube sections or are attached to the sampling tube sections by permanent or temporary means such as welding or by couplings. The nozzle may be torpedo shaped and resistant to rotation or conical and amenable to rotation. Depending on the shapes and characteristics of the components that make up the sampling assembly, an appropriate driving mechanism or combination of driving mechanisms is used.

At 1102, a cutting and capping mechanism is activated. This stage is optional. The use of the auxiliary tube both assists cutting and capping, as further described below, and reduces the need for cutting and capping. The need for cutting and capping is reduced by removing the pull of the vacuum on the sampled core.

At 1103, a pressurizing mechanism is activated through the auxiliary tube. The auxiliary tube remains capped during the descent of the sampling assembly. A check valve, or a similar mechanism, keeps the soils and sediments from entering the auxiliary tube as the sampling assembly is being pushed through the formation. When the sampling assembly reaches the desired depth, and substantially simultaneously with the retrieval of the sampling assembly, the pressurizing mechanism is activated. Compressed air or another fluid is forced through the auxiliary conduit, opens the check value near the nozzle and enters the borehole that is being evacuated as the sampling assembly is extracted. Entry of compressed air removes or reduces the vacuum in the borehole below the sampled core.

At 1104, the sampling assembly is retrieved.

Stages 1103 and 1104 occur substantially simultaneously. To prevent the formation of a vacuum, the borehole has to be supplied with air as it is being created. Then, no vacuum is generated and no pull is exerted on the sampled core.

At 1105, the collected core is removed from the sampling tubes as the sampling tube sections are extracted and uncoupled from the remainder of the sampling assembly.

At 1106, the method ends.

Figure 12:
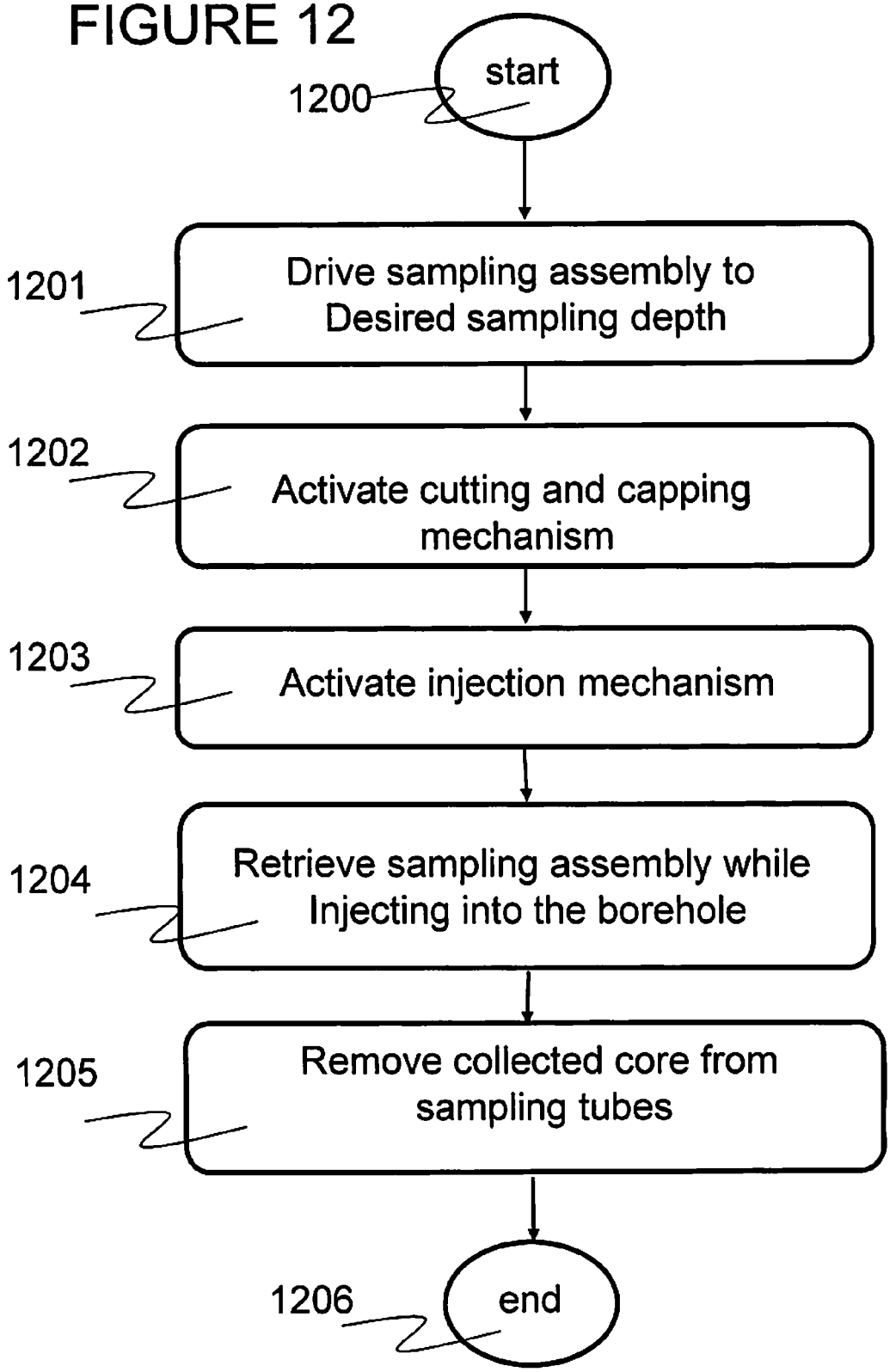
FIG. 12 shows a flowchart of a method of sealing a borehole substantially simultaneously with extraction of the sampling assembly from the borehole, according to aspects of the present invention

FIG. 12 shows a flowchart of a method of sealing a borehole substantially simultaneously with extraction of the sampling assembly from the borehole, according to aspects of the present invention.

At 1200, the method begins.

At 1201, the sampling assembly is driven to the desirable sampling depth in the formation.

At 1202, a cutting and capping mechanism is activated. This stage is optional.

At 1203, an injection mechanism is activated through the auxiliary tube. A sealing slurry may be injected into the borehole as the sampling assembly is retrieved. Alternatively, a disinfectant such as an oxidizing agent may be injected as the sampling assembly is being extracted. The chemical composition of the material that is injected into the borehole may be varied as a function of the location of the leading tip of the sampling assembly within the profile of the formation as the sampling assembly is being extracted. For example, one layer of the formation may be merely sealed with a bentonite slurry and another layer may receive nutrients that assist bioremediation of an aquifer that coincides with that layer.

At 1204, the sampling assembly is retrieved.

Stages 1203 and 1204 occur substantially simultaneously. The borehole is sealed as it is being created. Then, there is no opportunity for the borehole to remain open and operate as a pathway for transport of contaminants across the profile of the formation.

Moreover, the injection is occurring near the tip of the sampling assembly and once the sampling assembly is moved up from an area, the opportunity for effective injection into that are is no longer as viable.

At 1205, the collected core is removed from the sampling tubes as the sampling tube sections are extracted and uncoupled from the remainder of the sampling assembly. A protective washer insulates the core from the conduit and prevents contamination of the core by the fluid that flows in the auxiliary conduit.

At 1206, the method ends.

Both FIG. 11 and FIG. 12 include a cutting and capping step that is optional for reducing the vacuum or sealing the borehole. Cutting and capping of the sampled core by a mechanism that is activated using the auxiliary conduit is an additional and independent aspect of the present invention.

The term "translational" force and motion is used to distinguish the force, and the associated movement, that is distinguished from rotary and vibrational force and movement. Translational force and motion may be in a straight up and down direction or may be exerted and conducted at an angle. Drilling at an angle with the horizontal is conducted when the ground surface features, the type of underground formation, or the type of underground contamination dictate choosing a slanted well over a vertical well.

The present invention has been described in relation to particular examples, which are intended to be illustrative rather than restrictive, with the scope and spirit of the invention being indicated by the following claims and their equivalents.

The invention claimed is:

1. A device for collecting a sampled core from a formation, the device comprising:

sampling tube sections adapted to being coupled together to form a sampling tube for containing the sampled core;

a nozzle adapted for penetrating the formation and connected to a leading sampling tube section from among the sampling tube sections;

a cylinder having a threaded end and a penetrating end opposite the threaded end;

fins protruding outward from an external surface of the cylinder, not interfering with a translational movement of the device through the formation, and resisting a rotational movement of the nozzle once inside the formation; and auxiliary conduit sections adapted to being coupled together to form an auxiliary conduit along the sampling tube, the auxiliary conduit adapted for delivery of a fluid, wherein the auxiliary conduit is adapted to deliver the fluid to a borehole created by extraction of the device from the formation substantially simultaneously with the extraction of the device from the formation and creation of the borehole, wherein the auxiliary conduit includes a stopper for substantially preventing entry of soils and sediments into the auxiliary conduit during descent of the device into the formation, wherein the threaded end is adapted to be connected to the leading sampling tube section, and wherein the cylinder is adapted for receiving an O-ring, the O-ring adapted for deforming toward the sampled core, responsive to a compressive force resulting from a tightening of the threaded end to the leading sampling tube section.

2. The device of claim 1, wherein the nozzle is substantially conical to show little resistance to translational or rotational motion inside the formation.

3. The device of claim 1, wherein the auxiliary conduit sections are fabricated integrally with the sampling tube sections.

4. The device of claim 1, wherein the auxiliary conduit sections are attached to the sampling tube sections.

5. The device of claim 1, wherein the auxiliary conduit includes: a protective casing; and an internal tube running through the protective casing.

6. The device of claim 1, wherein the auxiliary conduit extends to the nozzle, and wherein the stopper is a check valve.

7. The device of claim 1, further comprising:

an inflatable core retainer ring adapted for being inflated by injection of the fluid from the auxiliary conduit and compressing the sampled core around a ring.

8. The device of claim 1, further comprising:

a cut and cap conduit for triggering a cut and cap mechanism near a leading end of the sampled core, wherein the cut and cap mechanism includes an inflatable core retainer ring adapted for being inflated by injection of fluid from the cut and cap conduit and compressing the sampled core around a ring.

9. A method for collecting core from a formation, the method comprising: driving a sampling assembly into the formation;

reaching a desired sampling depth;

withdrawing the sampling assembly from the formation;

activating an injection mechanism substantially simultaneously with the withdrawing of the sampling assembly to inject a fluid into a borehole being created by the withdrawing of the sampling assembly;

activating a containment mechanism before the withdrawing of the sampling assembly; and removing a collected core from the sampling assembly, wherein the sampling assembly includes a torpedo shaped nozzle for penetrating into the formation and a sampling tube screwed to the torpedo shaped nozzle for collecting the core, the torpedo shaped nozzle being receptive to translational insertion into the formation and resistive to rotation once inside the formation, wherein a deformable O-ring is placed in a space between the torpedo shaped nozzle and the sampling tube, the deformable O-ring adapted to deform toward a center of the sampling tube responsive to a compressive force, and wherein the activating of the containment mechanism includes:

rotating the sampling tube after the reaching of the desired sampling depth to tighten a space between the sampling tube and the torpedo shaped nozzle.

10. The method of claim 9, wherein the fluid is selected from compressed gas and slurry, wherein an injecting of the compressed gas into the borehole reduces suction a vacuum generated in the borehole, and wherein an injecting of the slurry into the borehole seals the borehole as the borehole is being formed.

11. The method of claim 9, wherein the activating of the containment mechanism includes:

injecting compressed gas into an inflatable core retainer ring located near a leading end of the sampling assembly.

* * * * *